US010136791B2

(12) United States Patent
Balinski et al.

(10) Patent No.: US 10,136,791 B2
(45) Date of Patent: Nov. 27, 2018

(54) CONVERTIBLE DISHWASHER

(75) Inventors: Steven B. Balinski, Saint Joseph, MI (US); Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1574 days.

(21) Appl. No.: 13/274,518

(22) Filed: Oct. 17, 2011

(65) Prior Publication Data

US 2013/0092188 A1 Apr. 18, 2013

(51) Int. Cl.
*A47L 15/42* (2006.01)
*A47L 15/00* (2006.01)

(52) U.S. Cl.
CPC ..... *A47L 15/4219* (2013.01); *A47L 15/4225* (2013.01); *A47L 15/4227* (2013.01); *A47L 15/0047* (2013.01); *A47L 15/4202* (2013.01)

(58) Field of Classification Search
CPC ..... A47L 15/4219; A47L 15/00–15/508
See application file for complete search history.

(56) References Cited

U.S. PATENT DOCUMENTS 6,182,674 B1 * 2/2001 Jozwiak et al. ..... 134/56 R
6,454,872 B1 9/2002 Miller et al.
7,146,992 B2 12/2006 Elick et al.
7,404,864 B2 7/2008 Welch
2008/0060690 A1 3/2008 Buser
2010/0037923 A1 2/2010 Dingler et al.

FOREIGN PATENT DOCUMENTS

EP 2253262 A1 11/2010

* cited by examiner

*Primary Examiner* — Spencer E Bell
(74) *Attorney, Agent, or Firm* — Diederiks & Whitelaw, PLC

(57) ABSTRACT

A dishwasher includes a filtration system that can be configured in a chopping or filtration only arrangement. A check valve cover attached to an accumulator is inserted into a main intake of a sump and divides the main intake into a fluid recirculation chamber in communication with a recirculation intake port, and a separate fluid draining chamber in communication with a drain port. When a drain pump is actuated, fluid is pulled from the accumulator through the drain port until pressure within the fluid draining chamber drops below the pressure of the sump and a check valve in the check valve cover is forced open, allowing fluid to be channeled out of the fluid recirculation chamber into the fluid draining chamber. Optionally, a fine filter system can replace the convertible filtration system, whereby the main intake is in fluid communication with both the recirculation intake port and the drain port.

20 Claims, 7 Drawing Sheets

CONVERTIBLE DISHWASHER

BACKGROUND OF THE INVENTION

Field of the Invention

The present invention pertains to the art of dishwashers and, more specifically, to a dishwasher including a sump which can be selectively employed with either a removable filtration system or a chopper pump system.

Description of the Related Art

Currently, there are two main wash systems utilized with dishwashers, i.e., chopper systems and filtration systems. In general, in connection with a chopper system, all soils in the washing fluid are directed to a chopping mechanism where the soils are made small enough to pass through the dishwasher's fluid pump, which distributes soil containing fluid to the spray arms of the dishwasher. At least some amount of this soil containing water is diverted to an accumulator/filter where soils are collected and separated from the water. A water nozzle from the spray arm sprays down onto a screen of the accumulator to keep the screen clean over the life of the product. Although chopper systems perform the function of reducing soil size, they also negatively impact the flow of fluid and load on the motor. This leads to a larger pump motor than would be required if no chopping function was performed. Such a system is also louder than simple filtration units because of the larger motor and the sound of the chopper blade turning in the water. Advantageously, chopper systems are self-cleaning, remaining maintenance free. One example of a chopper system can be seen in U.S. Pat. No. 7,404,864, which is incorporated herein by reference.

In a filtration system, soil that might restrict flow through the spray arm nozzles is captured upstream of a recirculation pump by filters in order to prevent the soil from re-depositing on dishware being washed. The filters are typically set up with multiple filters, including at least one fine filter that allows only small, non-nozzle blocking particles through to the fluid pump. One example of such a system can be seen in U.S. Patent Application Publication No. 2010/0037923, which is incorporated herein by reference. A brief description of the '923 dishwasher will now be discussed with reference to FIGS. 1-3.

In general, a dishwasher 2 includes a tub 5 having bottom, side and rear walls 8-11, as well as a top wall (not shown). Tub 5 defines a washing chamber 14, which is selectively sealed by a door 20 including a detergent tray 23. Disposed within tub 5 is a filtration system 30 including a central main strainer or filter screen 36 and a secondary strainer 39. A heating element 44 is positioned above bottom wall 8. A circulation pump (not shown) directs washing fluid from a sump unit 50 (seen in FIG. 2) to a fluid distribution manifold indicated at 53. In a manner known in the art, fluid distribution manifold 53 supplies washing fluid to at least a lower wash arm 55 and a conduit 57 leading to an upper spray arm (not shown). Fluid distribution manifold 53 is also in fluid communication with spray manifold assembly 59, including a plurality of spray discs 62. As depicted in FIGS. 2 and 3, sump unit 50 generally includes a sump enclosure 68 and a recessed main intake 73 having an outlet or recirculation intake port 80 leading to a circulation pump (not shown). Filter screen 36 constitutes a first-pass screen filter having a shape that aids in channeling washing fluid across the screen to secondary strainer 39. In general, washing fluid flows through a screen portion 75 of strainer 39 before entering main intake 73 and exiting outlet 80. Filter screen 36 is substantially circular and is supported along its outer circumferential edge 90 by filter support surface 83 and seals against filter support surface 83. Filter screen 36 includes a main body portion 100 having an aperture 105 there through and arm portions 108 and 109 which define a central opening 112 in the form of a slot there between. When assembled, central opening 112 fits around fluid distribution manifold 53 and aperture 105 extends over main intake 73. In this example, an additional filter (not shown) located adjacent exiting outlet 80 works alongside filter 39 to capture soil particles upstream of a fluid recirculation pump (not shown) in main intake area 73, and allows these soil particles to pass through a drain pump intake (not shown) when a drain pump is actuated.

With each type of washing system, there are positive and negative aspects. For instance, as indicated above in discussing the chopper system, a larger motor is generally required in order to drive both the pump and the chopper. With a filtration system, it is common for one or more of the filters to require periodic removal for cleaning by a consumer. In any case, both types of systems are desirable, simply for different reasons. To this end, both systems are commonly found on the market. Given the different requirements for each system, the tub, sump, pump mountings and other structural details are unique to the particular type of system. With this in mind, it would be advantageous to provide an overall dishwasher tub and sump arrangement which could be readily adapted for use with either filtration or chopper-type systems.

SUMMARY OF THE INVENTION

The present invention is directed to a dishwasher having a convertible filtration system for use with a universal sump unit. In general, the removable filtration system is adapted to be utilized in a chopping type dishwasher arrangement or in a filtration only dishwasher arrangement. More specifically, a check valve cover attached to an accumulator is inserted into a recessed main intake of the sump unit such that the check valve cover divides the recessed main intake into a fluid recirculation chamber in communication with a recirculation intake port, and a separate fluid draining chamber in communication with a drain port. During a dishwashing cycle, washing fluid is pumped by a recirculation pump to fluid supply hub attached to a spray arm. A portion of fluid within the fluid supply hub is channeled through a bypass port to a filter chamber of the accumulator, where fine particles are filtered out of fluid exiting the accumulator. Particulates within the filter chamber are channeled into the draining chamber by the check valve cover.

When the filtration system is in a chopping type dishwasher arrangement, fluid from a tub of the dishwasher enters the fluid recirculation chamber through a coarse filter, and is channeled through a chopping assembly before being pumped to the fluid supply hub by the recirculation pump. When in a filtration with accumulator dishwasher arrangement, a substantially cylindrical fine filter is inserted into the recessed main intake between a side wall of the intake and the check valve cover. Fluid entering the fluid recirculation chamber is filtered through the fine filter before being pumped to the fluid supply hub by the recirculation pump. In either configuration, when a drain pump is actuated, fluid, as well as any entrained particles therein, is pulled from the accumulator before fluid is pulled directly from the tub. More specifically, fluid is pulled from the accumulator through the drain port until pressure within the fluid draining chamber drops below the pressure of the sump unit. The low pressure forces a check valve in the check valve cover to open, allowing fluid from the sump unit to be channeled out of the fluid recirculation chamber into the fluid draining chamber below. Washing fluid exits the fluid draining chamber through a drain port and is discharged in a manner known in the art. This design also allows the unit to function as a filtration only unit. When in the filtration only configuration, a cylindrical fine filter is inserted into the recessed main intake without a check valve.

An additional feature of the present invention is the convertible nature of the sump unit. Specifically, a non-chopping or fine filter system can replace the convertible filtration system of the present invention. Thus, when the convertible filtration system is utilized, the drain check cover divides the recessed main intake into a fluid recirculation chamber in communication with the recirculation intake port, and a separate draining chamber in communication with the drain port, and when the fine filter system is utilized, the recessed main intake is simultaneously in communication with both the recirculation intake port and the drain port.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 4:
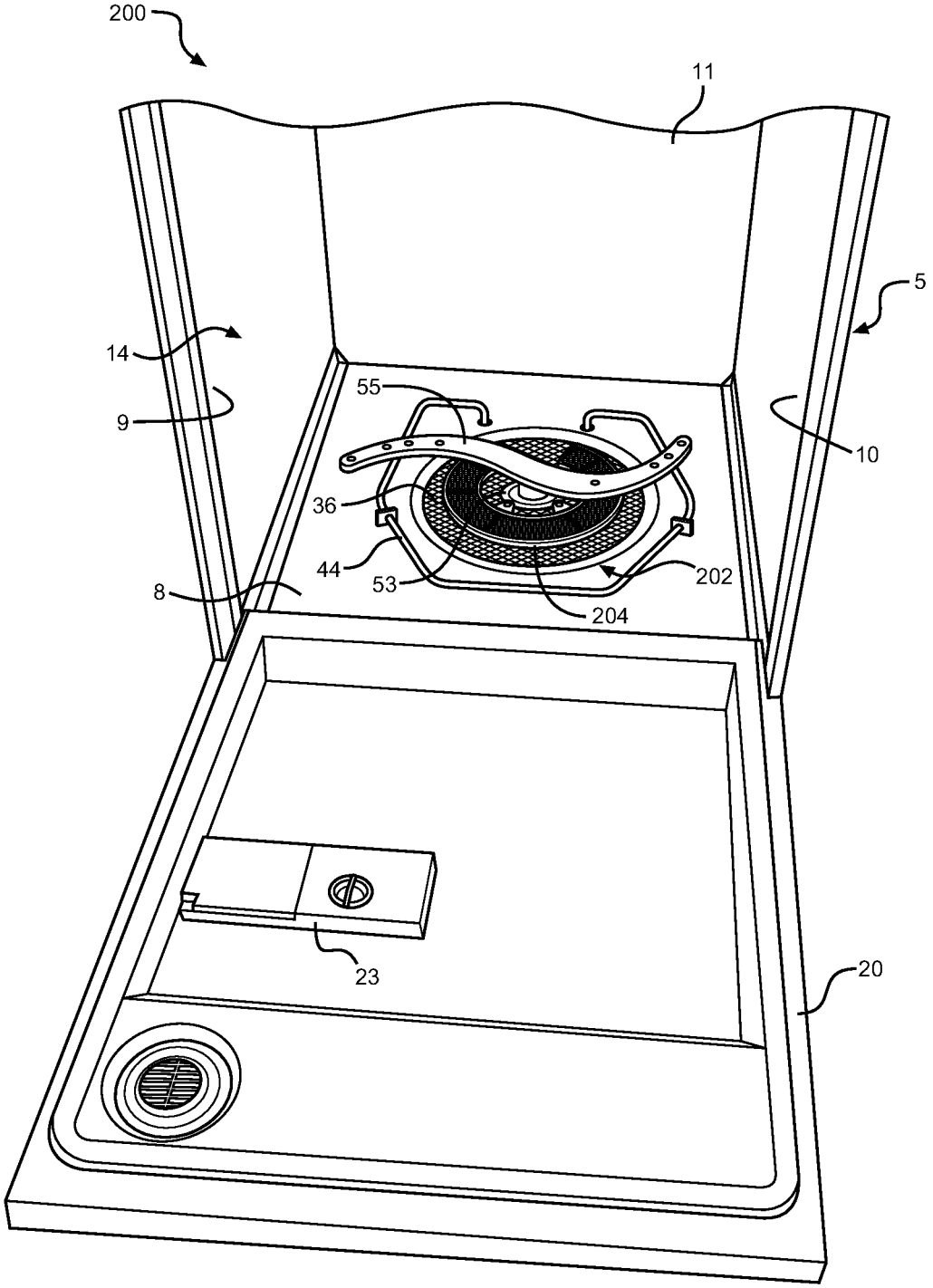
FIG. 4 is a perspective view of a dishwasher constructed in accordance with the present invention.

With initial reference to FIG. 4, a dishwasher 200 is shown including a convertible filtration system 202 constructed in accordance with the present invention. Filtration system 202 is adapted to be utilized in a chopping type dishwasher arrangement or in a filtration only dishwasher arrangement, as will be discussed in more detail below. Certain structure of dishwasher 200 is the same or substantially the same as that of dishwasher 2 of FIG. 1, such that like reference numbers correspond to identical parts. Conduit 57 and spray manifold assembly 59 are not shown for the sake of simplicity, but it should be understood that various water distribution arrangements could be utilized.

Figure 5:
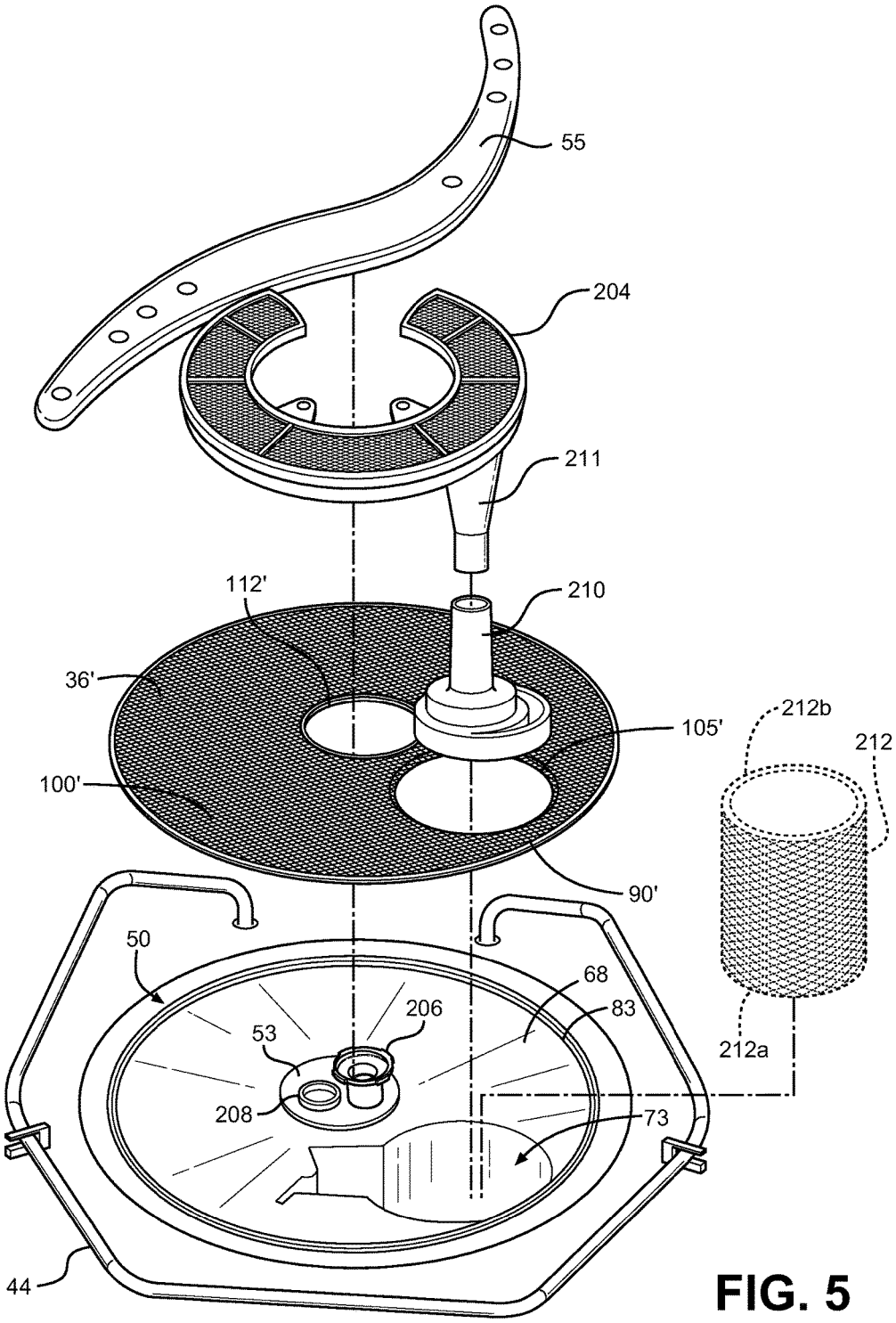
FIG. 5 is a partial exploded view of the dishwasher of FIG. 4.

Details of filtration system 202 of the present invention will now be discussed with reference to FIG. 5. In the embodiment shown, central main strainer 36' includes a main body portion 100' having an aperture 105' and a central opening 112'. It should be understood that the central main strainer of the present invention can take many different forms depending on the type of water distribution systems utilized within dishwasher 200. For example, if dishwasher 200 where constructed to include a conduit 57 and spray manifold assembly 59 (shown in FIG. 1), then the central main strainer can be in the form of central main strainer 36 depicted in FIGS. 1 and 2. Regardless of the particular configuration, when assembled, central opening 112' of central main strainer 36' fits over distribution manifold 53 such that a fluid supply hub 206 for attachment of spray arm 55, and an auxiliary port 208 for attachment to another fluid conduit (not shown) extend through central opening 112'. Filtration system 202 further includes an accumulator 204 which attaches to a check valve cover 210 via a funnel portion 211 of accumulator 204. When assembled, check valve cover 210 and funnel portion 211 extend through aperture 105' into recessed main intake 73. Preferably, check valve cover 210 is simply seated in recessed main intake 73, but could be secured in position, such as through the use of a clasp arrangement employed to lock the fine strainer 39 in place in the prior art referenced above. An optional fine filter 212, which can also be inserted into recessed main intake 73, is provided for use in further filtering washing fluid as will be discussed in more detail below. In general, fine filter 212 is comprised of a substantially circular fine filter screen having a bottom wall 212*a* and a top wall 212*b* defining a central opening there through.

Figure 6:
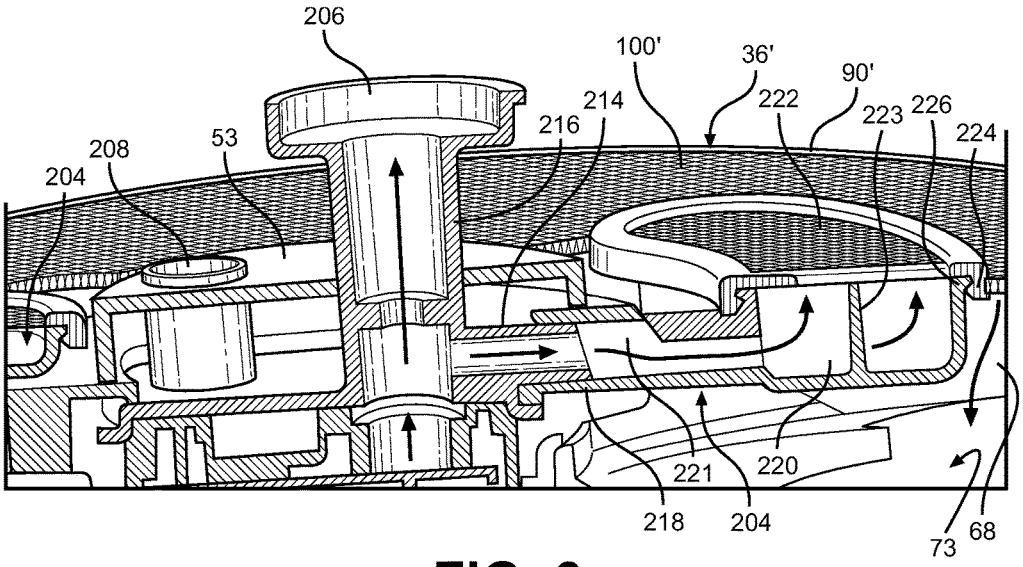
FIG. 6 is a partial cross-sectional view of a portion of the dishwasher of FIG. 4.

Details regarding the function of filtration system 202 will now be discussed with reference to FIG. 6. In a manner known in the art, during a washing cycle initiated by a user, washing fluid pumped by a recirculation pump 213 (depicted in FIG. 7) forces washing fluid up through fluid supply hub 206 to attached spray arm 55 (shown in FIG. 5), which sprays washing fluid within washing chamber 14. Washing fluid may also supply another spray arm or manifold, such as spray arm assembly 59 depicted in FIG. 1, through auxiliary port 208. A bypass port 214 extends from a main conduit 216 connected to fluid supply hub 206 and is friction fit to an inlet port 218 of an accumulator filter chamber 220 such that a small percentage of the fluid flowing from recirculation pump 213 is directed into accumulator 204. In the embodiment shown, inlet port 218 has an initial diameter which is wider than the diameter of bypass port 214, but narrows before linking to accumulator filter chamber 220, thereby forming a pressure relief venturi portion 221.

With this arrangement, during the dishwashing cycle, a portion of washing fluid directed toward fluid supply hub 206 is diverted through bypass port 214 to accumulator filter chamber 220, with the majority of the washing fluid being forced out of filter chamber 220 and back into washing chamber 14 through a fine filter screen 222. Although depicted with a reinforcing member 223 extending up within accumulator filter chamber 220, accumulator filter chamber 220 is preferably defined by a single chamber. In any case, particles of food entrained in the washing fluid are filtered out of the washing fluid exiting through fine filter screen 222 into tub 5, with the particles collecting in filter chamber 220. In the preferred embodiment shown, fine filter screen 222 is in the form of a cover plate having outer flange portions 224 adapted to snap onto or otherwise engage a mounting portion 226 of accumulator 204. Fine filter screen 222 is positioned such that lower nozzles (not shown) on wash arm 55 direct fluid onto fine filter screen 222 to clean accumulated particles off of fine filter screen 222 during a washing cycle.

Figure 7:
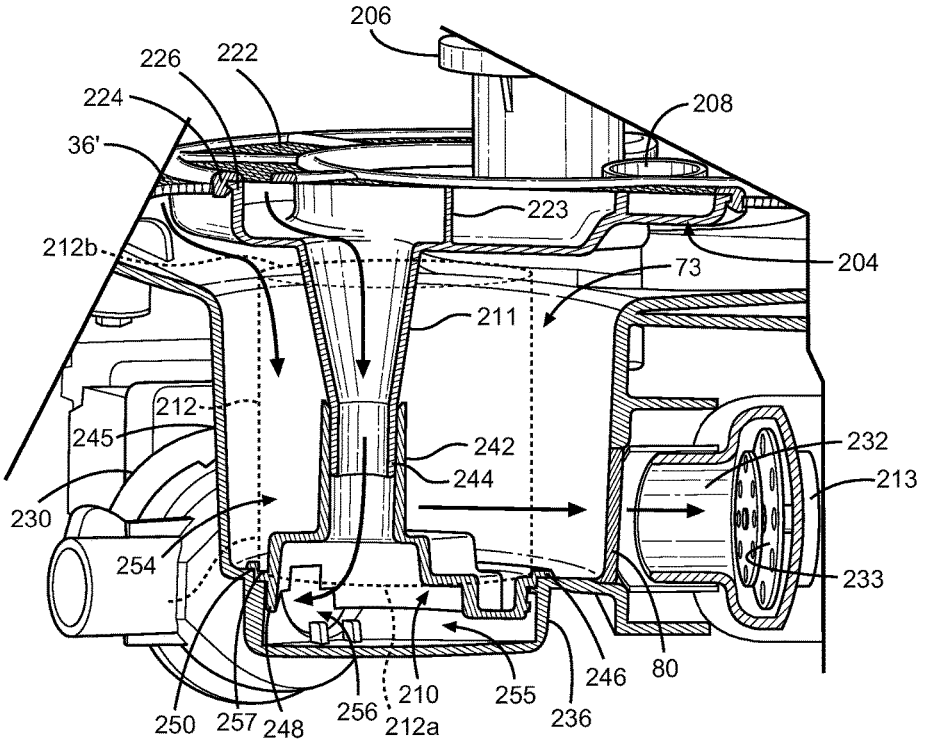
FIG. 7 is a further cross-sectional view of the water distribution and filtration system of the invention.

The manner in which washing fluid is channeled to a drainage pump 230 and recirculation pump 213 will now be discussed with reference to FIG. 7. In a first embodiment, filtration system 202 is utilized in a chopping type dishwashing arrangement. In use, washing fluid flowing into sump unit 50 during the dishwashing cycle will flow by gravity through central main strainer 36' into recessed main intake 73. Central main strainer 36' acts as a coarse particle strainer to prevent coarse particles from entering recessed main intake 73. However, washing fluid flowing into recessed main intake 73 may carry fine particles which are carried with the washing fluid into recirculation intake port 80 to a recirculation pump inlet generally indicated at 232 and to a chopper assembly 233. In a manner known in the art, chopper assembly 233 macerates particles entrained within washing fluid to be recirculated to fluid supply hub 206 by recirculation pump 213. Various types of chopping mechanisms are known in the art which could be utilized in conjunction with the present invention. See, for example, U.S. Pat. Nos. 7,146,992 and 7,404,864 which are incorporated herein by reference. In one particular preferred embodiment, the chopper assembly 233 is constructed by a blade rotating on a perforated metal disc, with the perforations being very small, such as in the order of 1-1.2 mm in diameter. In this way, particles flowing into wash arm 55 from fluid distribution manifold 53 are small enough such that they do not clog wash arm 55 or otherwise interfere with the distribution of washing liquid into tub 5.

Washing fluid within filter chamber 220 of accumulator 204 carries fine particles collected in filter chamber 220 to funnel portion 211 and into a bottom portion 236 of main intake 73 through drain check cover 210. In a preferred embodiment, a tubular inlet portion 242 of drain check cover 210 frictionally fits about a tubular outlet 244 of funnel portion 211 to removably connect drain check cover 210 to accumulator 204. Funnel portion 211 and tubular inlet portion 242 of drain check cover 210 are arranged radially inward from an upper side wall 245 of main intake 73 such that the presence of accumulator 204 does not significantly impact the fluid capacity of main intake 73. Drain check cover 210 further includes a mounting flange 246 that extends about the periphery of a bottom mounting portion 248 and seals against a ledge 250 extending about the periphery of the bottom portion 236 of main intake 73. With this configuration, drain check over 210 is fluidly connected to accumulator 204, while being disposed in and dividing main intake 73 into an upper fluid recirculating chamber 254 in fluid communication with recirculation pump 213, and a separate, bottom fluid draining chamber 255 in communication with drain pump 230 through a drain port 256.

Figure 8:
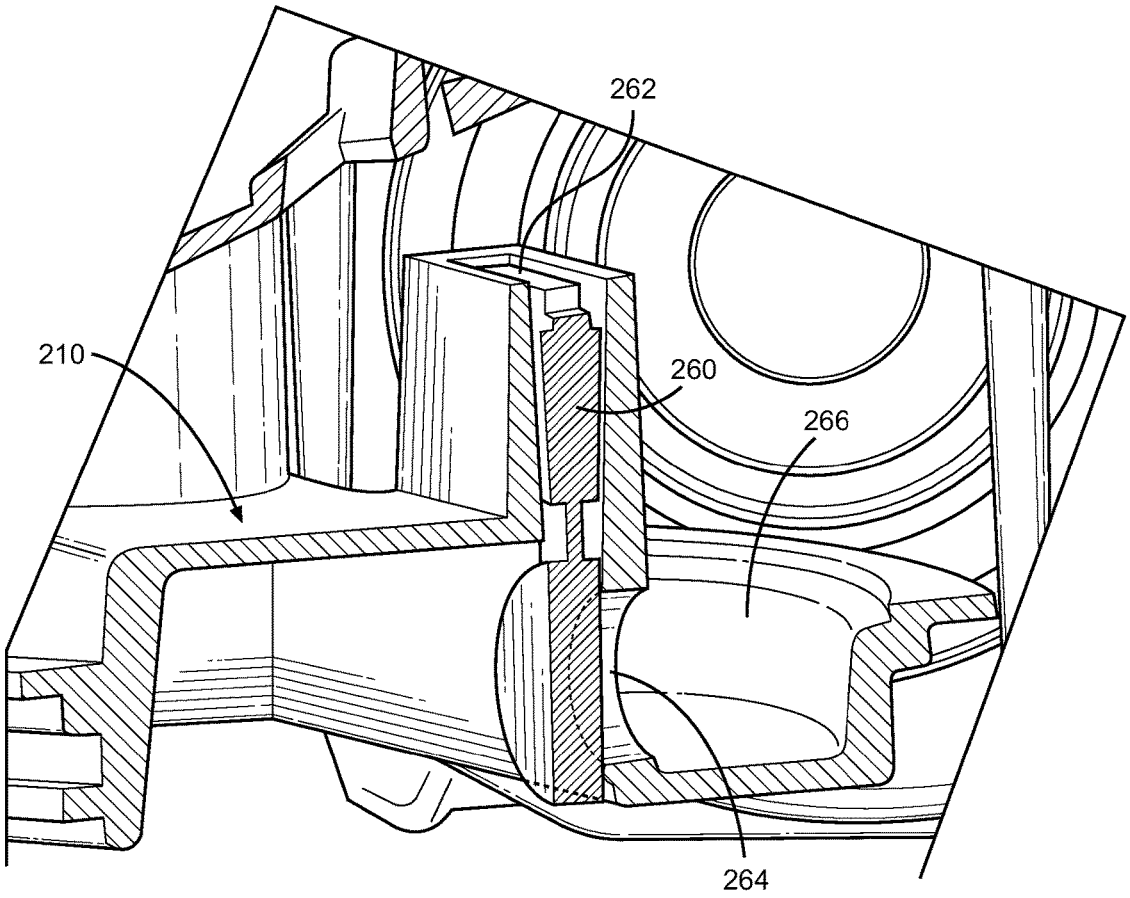
FIG. 8 is a partial cross-sectional view of a check valve cover incorporated in the water distribution and filtration system of FIG. 7.

As best seen in FIG. 8, drain check cover 210 includes a check valve 260 attached to an inner wall 262, with check valve 260 functioning to seal a fluid inlet 264 adjacent a trough 266 when in an un-actuated or sealing position. With this arrangement, when drain pump 230 is actuated, washing fluid, and any entrained particles therein, are pulled from accumulator 204 before washing fluid is pulled from sump unit 50. More specifically, washing fluid and accumulated particles are pulled from accumulator 204 through drain port 256 until pressure within fluid draining chamber 255 drops below the pressure of sump unit 50. The low pressure forces check valve 264 open, allowing fluids from sump unit 50 to be channeled by trough 266 out of fluid recirculation chamber 254, through fluid inlet 264, and into fluid draining chamber 255. Washing fluid exiting fluid draining chamber 255 via drain port 256 is discharged from dishwasher 200 in a manner known in the art.

In a second embodiment, filtration system 202 is utilized in a filtration only dishwashing arrangement. More specifically, when a filtration with accumulator only dishwashing arrangement is desired, accumulator 204 and check valve cover 210 are inserted into recessed main intake 73 in the manner described above, followed by, or as part of, fine filter 212. See FIG. 7. Preferably, bottom wall 212*a* of fine filter 212 mounts or is otherwise secured to check valve cover 210, and top wall 212*b* of fine filter 212 extends to accumulator 204 or up to filter screen 36, such that fluid entering upper fluid recirculation chamber 254 from tub 5 is filtered by fine filter 212 before entering recirculation pump inlet 232. In the embodiment shown in FIG. 7, bottom wall 212*a* of fine filter 212 fits within a filter receiving aperture 257 within check valve cover 210 to secure fine filter 212 to check valve cover 210. However, fine filter 212 could also be made part of check valve cover 210. Preferably, accumulator 204 is configured for easy removal from sump unit 50 such that fine filter 212 can be accessed by a user for cleaning. When drain pump 230 is actuated, washing fluid, along with any entrained particles therein, are pulled from accumulator 204 before washing fluid is pulled from sump unit 50. More specifically, washing fluid is pulled from accumulator 204 through drain port 256 until pressure within fluid draining chamber 255 drops below the pressure of sump unit 50. The low pressure forces check valve 264 open, allowing fluids from fluid recirculation chamber 254 to be channeled through fluid inlet 264, and into fluid draining chamber 255. Again, washing fluid exiting fluid draining chamber 255 via drain port 256 is discharged from dishwasher 200 in a manner known in the art.

Figure 1:
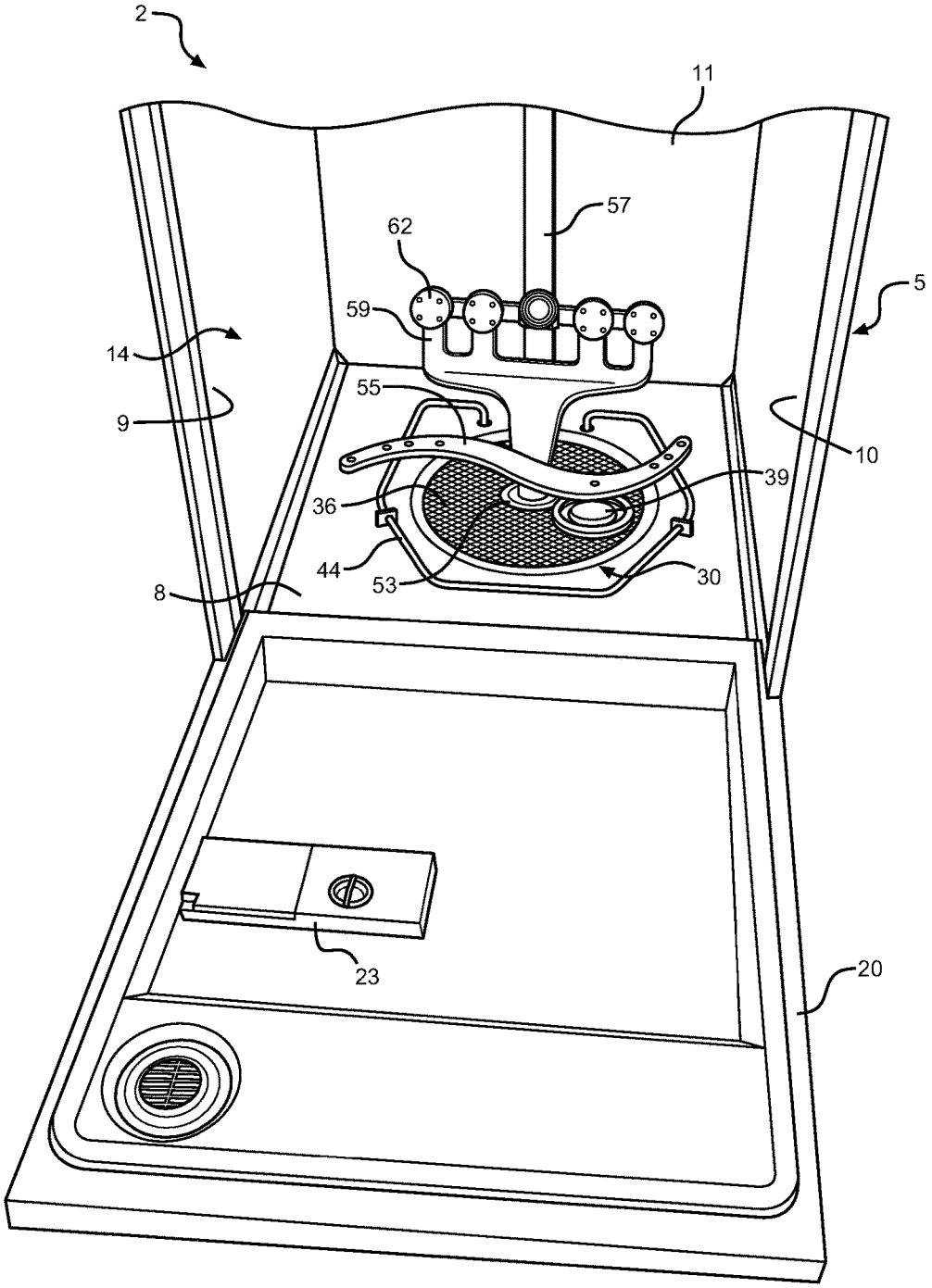
FIG. 1 PRIOR ART
FIG. 1 is a partial perspective view of a dishwasher constructed in accordance with a known dishwasher arrangement.
Figure 2:
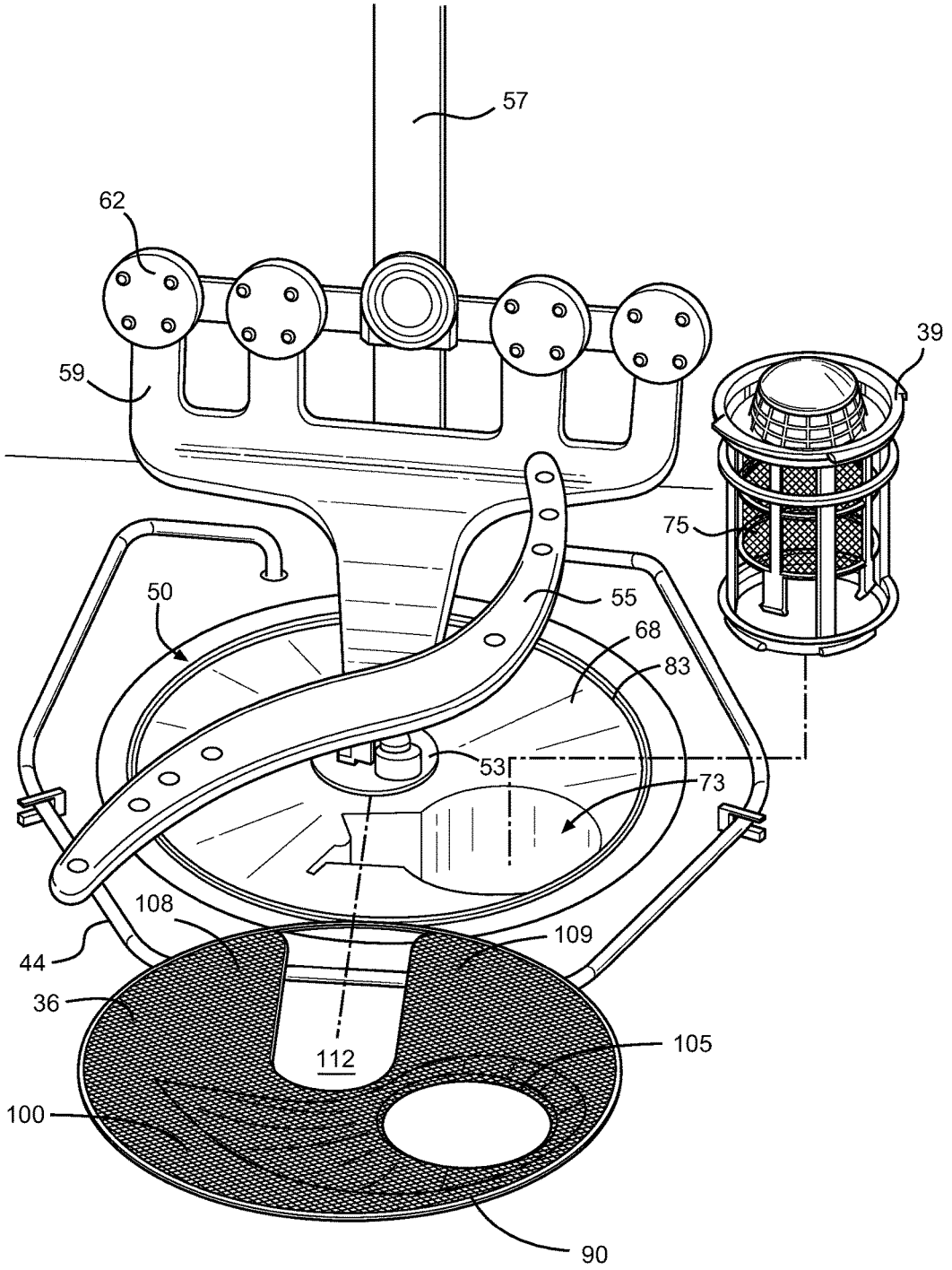
FIG. 2 PRIOR ART
FIG. 2 is a partial exploded view of a water distribution and filtration system of the dishwasher of FIG. 1.
Figure 3:
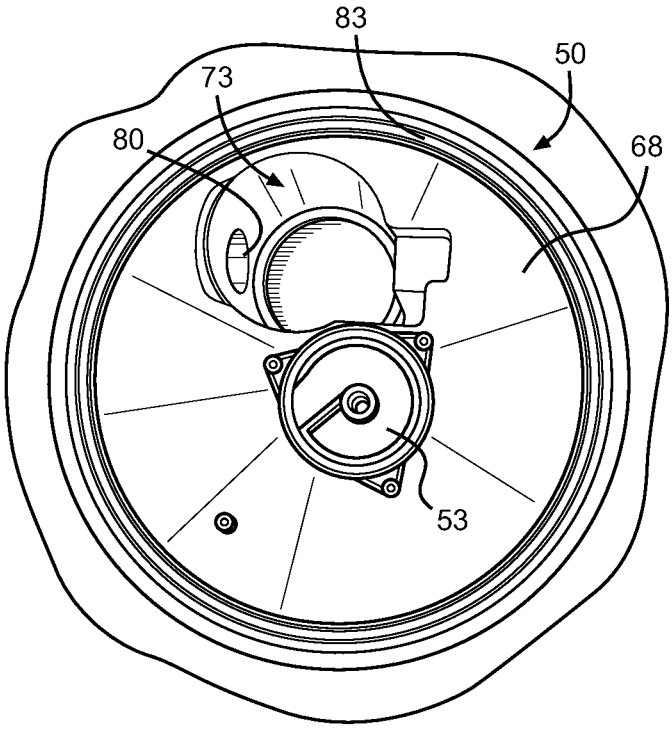
FIG. 3 PRIOR ART
FIG. 3 is an upper perspective view of the known removable filtration system of FIG. 2.

At this point, it should be recognized that a feature of the present invention is the advantageous convertible nature of dishwasher 200. That is, sump unit 50 establishes a universal sump unit configured to be utilized with the convertible filtration system 202 described above, as well as with a non-chopping or fine filter system wherein a main intake filter, such as fine filter 39 of FIGS. 1 and 2, is utilized. More specifically, during assembly of dishwasher 200, a manufacturer can select between the convertible filtration system 202 described above and the fine filtration system utilizing fine strainer 39. When the fine filtration system is selected, fine filter 39 is inserted into recessed main intake 73 and performs the function of filtering washing fluid flowing into recessed main intake 73 from tub 5 in a manner known in the art. However, when universal sump unit 50 is utilized with check valve cover 210, a closed system is created, separate from the sump, where soils can be accumulated during the washing of dishes. Specifically, drain check cover 210 divides recessed main intake 73 into fluid recirculation chamber 254 in communication with recirculation intake port 80 and separate draining chamber 255 in communication with drain port 256, and when universal sump unit 50 is utilized with the fine filtration system, recessed main intake 73 is simultaneously in communication with both recirculation intake port 80 and drain port 256.

Advantageously, the present invention allows for a single dishwasher tub and sump arrangement to be readily adapted for use with either a chopping type filtration system or a non-chopping filtration system. Thus, a manufacturer or user can select the type of system to be used based on each system's advantages/disadvantages and the particular desires or needs of the user. For example, the chopping type filtration arrangement is self-cleaning and relatively maintenance free, while the non-chopping filtration arrangement can utilize a smaller pump motor and is generally quieter than the chopping type filtration arrangement. Additionally, when utilized, accumulator 204 reduces the amount of soil re-deposited on dishes. The wash water is therefore cleaner and can be used longer, requiring less water to clean the dishes. Further, accumulator 204 is positioned such that backwash nozzles (not shown) used to clean accumulator filter screen 222 are the same nozzles used to clean main filter screen 36 when accumulator 204 is not utilized. Thus, manufacturing costs are reduced by providing dishwasher parts that can be utilized in conjunction with the different filtration arrangements discussed above.

Although described with reference to preferred embodiments of the invention, it should be readily understood that various changes and/or modifications can be made to the invention without departing from the spirit thereof. For instance, although dishwasher 200 is depicted with only a single spray arm 55, it should be understood that dishwasher 200 can include an upper spray arm and even additional spray arms or other fluid distribution systems desired. In fact, the invention can be employed in a dishwasher having a wide range of spray devices, including rotatable spray arms, spray discs, fixed heads and the like. Additionally, when non-chopping filtration is desired, the drain check cover and accumulator arrangement of the invention could be used with filter arrangements other than filter 222. In general, the invention is only intended to be limited by the scope of the following claims.

What is claimed is:

1. A dishwasher having a filtration system comprising:

a tub defining a washing chamber;

at least one spray device mounted in the washing chamber;

a sump unit within the washing chamber including a recessed main intake defined, at least in part, by a side wall and having a recirculation intake port and a drain port;

an accumulator;

a drain check cover fluidly connected to the accumulator and removably disposed in the recessed main intake wherein, with the drain check cover disposed in the recessed main intake, the drain check cover divides the recessed main intake into a fluid recirculation chamber, to which the recirculation intake port is exposed, and a fluid draining chamber, to which the drain port is exposed, and, with the drain check cover not disposed in the recessed main intake, the recessed main intake is not divided into the fluid recirculation chamber and the fluid draining chamber, and the recirculation intake port and the drain port are both exposed to the recessed main intake; and a recirculation pump connected to the recirculation intake port and fluidly interposed between the sump unit and each of the at least one spray device and the accumulator, wherein the dishwasher is configured so that, during operation of the dishwasher, the recirculation pump causes fluid to flow through the at least one spray device whether or not the drain check cover is disposed in the recessed main intake.

2. The dishwasher according to claim 1, wherein the drain check cover includes a tubular portion spaced radially inward from the side wall within the recessed main intake.

3. The dishwasher according to claim 1, wherein the drain check cover includes a lower portion sealing the fluid recirculation chamber from the fluid draining chamber, between the recirculation intake port and the drain port.

4. The dishwasher according to claim 3, wherein the drain check cover further comprises a check valve selectively sealing a fluid inlet providing fluid communication between the fluid recirculation chamber and the fluid draining chamber.

5. The dishwasher according to claim 3, wherein the fluid draining chamber is defined within the recessed main intake below the drain check cover.

6. The dishwasher according to claim 3, wherein the recessed main intake is provided with an internal ledge, said lower portion being seated upon the internal ledge.

7. The dishwasher according to claim 1, further comprising:

a drain pump connected to the drain port; and a chopper assembly provided in combination with the recirculation pump.

8. The dishwasher according to claim 1, further comprising:

a fine filter located within the recessed main intake between the side wall and the drain check cover to filter fluid entering the recessed main intake.

9. The dishwasher according to claim 8, wherein the fine filter is secured to the drain check cover.

10. The dishwasher according to claim 8, wherein the fine filter includes a central opening, and the drain check cover is received in the central opening of the fine filter.

11. The dishwasher according to claim 1, wherein the drain check cover is configured to be received in a central opening of a fine filter.

12. The dishwasher according to claim 1, wherein the drain check cover includes a filter receiving aperture configured to secure a fine filter to the drain check cover.

13. A method of operating a dishwasher including a tub defining a washing chamber, at least one spray device mounted in the washing chamber, a sump unit within the washing chamber including a recessed main intake defined, at least in part, by a side wall and having a recirculation intake port and a drain port, an accumulator, a drain check cover fluidly connected to the accumulator and removably disposed in the recessed main intake, and a recirculation pump connected to the recirculation intake port and fluidly interposed between the sump unit and each of the at least one spray device and the accumulator, wherein, with the drain check cover disposed in the recessed main intake, the drain check cover divides the recessed main intake into a fluid recirculation chamber, to which the recirculation intake port is exposed, and a fluid draining chamber, to which the drain port is exposed, and wherein, with the drain check cover not disposed in the recessed main intake, the recessed main intake is not divided into the fluid recirculation chamber and the fluid draining chamber, and the recirculation intake port and the drain port are both exposed to the recessed main intake, the method comprising:

directing washing fluid into the fluid recirculation chamber;

operating the recirculation pump to draw the washing fluid from the recirculation intake port;

directing the washing fluid from the recirculation pump to both the at least one spray device and the accumulator, wherein the recirculation pump causes fluid to flow through the at least one spray device whether or not the drain check cover is disposed in the recessed main intake;

collecting particulates from the washing fluid flowing through the accumulator; and operating a drain pump to draw washing fluid and the particulates from the accumulator to the fluid draining chamber through the drain check cover.

14. The method of claim 13, further comprising:

filtering the washing fluid entering the recessed main intake of the sump unit from the washing chamber.

15. The method of claim 13, further comprising: pivoting a check valve to unblock a fluid inlet connecting the fluid recirculation chamber and the fluid draining chamber upon operating the drain pump.

16. The method of claim 13, further comprising: chopping particulates entrained in the washing fluid upon operating the recirculation pump.

17. The method of claim 16, further comprising:

fine filtering the washing fluid within the recessed main intake prior to directing the washing fluid from the recirculation pump to both the at least one spray device mounted in the washing chamber and the accumulator.

18. The method of claim 13, further comprising, upon operating the drain pump, initially causing the particulates to be drained from the accumulator and fluid draining chamber, followed by washing fluid being drained from the fluid recirculation chamber.

19. A dishwasher having a filtration system comprising:

a tub defining a washing chamber;

at least one spray device mounted in the washing chamber;

a sump unit within the washing chamber including a recessed main intake defined, at least in part, by a side wall and having a recirculation intake port and a drain port, wherein the recirculation intake port and the drain port are formed in the side wall of the recessed main intake;

an accumulator;

a drain check cover fluidly connected to the accumulator and removably disposed in the recessed main intake wherein, with the drain check cover is disposed in the recessed main intake, the drain check cover divides the recessed main intake into a fluid recirculation chamber, to which the recirculation intake port is exposed, and a fluid draining chamber, to which the drain port is exposed, and, with the drain check cover is not disposed in the recessed main intake, the recessed main intake is not divided into the fluid recirculation chamber and the fluid draining chamber, and the recirculation intake port and the drain port are both exposed to the recessed main intake; and a recirculation pump connected to the recirculation intake port and fluidly interposed between the sump unit and each of the at least one spray device and the accumulator.

20. The dishwasher according to claim 19, wherein the recirculation intake port is located such that fluid flowing through the recirculation intake port exits the recessed main intake in an outward direction relative to a center of the recessed main intake.

* * * * *